US005183380A

United States Patent [19]

Focke et al.

[11] Patent Number: 5,183,380

[45] Date of Patent: Feb. 2, 1993

[54] APPARATUS INCLUDING AN ENDLESS POCKET CONVEYOR FOR AUTOMATICALLY TRANSFERRING STACKS OF PACKAGING BLANKS TO A BLANK MAGAZINE OF A PACKAGING MACHINE

[75] Inventors: Heinz Focke; Kurt Liedtke, both of Verden, Fed. Rep. of Germany

[73] Assignee: Focke & Co., Verden, Fed. Rep. of Germany

[21] Appl. No.: 635,097

[22] Filed: Dec. 28, 1990

[30] Foreign Application Priority Data

Jan. 16, 1990 [DE] Fed. Rep. of Germany ..... 4001051

[51] Int. Cl.[5] ..... B65G 65/02

[52] U.S. Cl. ..... 414/795.8; 414/790.4; 414/790.5

[58] Field of Search ..... 414/795.8, 796.2, 790.4, 414/796.5; 198/468.1, 468.11

[56] References Cited

U.S. PATENT DOCUMENTS

| | | | |
|---|---|---|---|
| 2,827,148 | 3/1958 | Engleson et al. | 198/468.11 |
| 3,027,021 | 3/1962 | Kramer | 414/795.8 X |
| 3,050,173 | 8/1962 | Wimmer | 198/468.11 X |
| 3,360,100 | 12/1967 | Seragnoli | 198/468.11 X |
| 3,960,280 | 6/1976 | Stolzer | 414/796.2 |
| 4,022,315 | 5/1977 | Hori et al. | 198/468.1 X |
| 4,029,194 | 6/1977 | Feurstein et al. | 198/468.1 X |
| 4,139,108 | 2/1979 | Kamp et al. | 198/468.11 X |
| 4,164,278 | 8/1979 | Gurioli | 198/468.1 |
| 4,205,934 | 6/1980 | Pantin et al. | 414/796.2 X |
| 4,493,599 | 1/1985 | Hartness et al. | 414/796.2 |
| 4,592,462 | 6/1986 | Mojden et al. | 414/795.8 X |
| 4,662,624 | 5/1987 | Focke | 414/795.8 X |
| 4,907,941 | 3/1990 | Focke | 414/795.8 |
| 4,955,794 | 9/1990 | Fluck | 414/790.4 |

FOREIGN PATENT DOCUMENTS

| | | | |
|---|---|---|---|
| 368743 | 11/1982 | Austria . | |
| 258597 | 3/1988 | European Pat. Off. . | |
| 1556258 | 2/1970 | Fed. Rep. of Germany . | |
| 2022602 | 11/1970 | Fed. Rep. of Germany . | |
| 1953772 | 5/1971 | Fed. Rep. of Germany . | |
| 3519580 | 3/1987 | Fed. Rep. of Germany . | |
| 3307675 | 10/1987 | Fed. Rep. of Germany . | |
| 3627868 | 2/1988 | Fed. Rep. of Germany . | |
| 3627670 | 3/1988 | Fed. Rep. of Germany . | |
| 3811993 | 11/1988 | Fed. Rep. of Germany . | |
| 3738102 | 5/1989 | Fed. Rep. of Germany . | |
| 3827916 | 2/1990 | Fed. Rep. of Germany . | |
| 3827915 | 3/1990 | Fed. Rep. of Germany . | |
| 2300726 | 9/1976 | France . | |
| 2589458 | 5/1987 | France . | |
| 672939 | 5/1952 | United Kingdom | 414/796.2 |
| 2197299 | 5/1988 | United Kingdom | 414/795.8 |

*Primary Examiner*—David A. Bucci
*Assistant Examiner*—Janice Krizek
*Attorney, Agent, or Firm*—Sughrue, Mion, Zinn, Macpeak & Seas

[57] ABSTRACT

In the production of (cigarette) packs made of blanks of thin cardboard, the latter are delivered as blank stacks, normally stacked on pallets. The blank stacks delivered in this or other ways have to be continuously filled into supply magazines of high performance packaging machines. It is therefore necessary, particularly because of the high working speed of the packaging machines, to mechanize and to a large extent automate the transport of the blank stacks. Transporting blank stacks is quite problematic because of accelerations and decelerations occurring at the same time. The basic embodiment of the invention therefore provides a so-called endless pocket conveyor between a feed station and a supply magazine, the pockets of the conveyor holding a blank stack each and not only transporting the blank stacks but also fixing them in proper stack position during transport so that individual stacks can be automatically pushed out of the conveyor pockets and into the magazine. Insofar as further shifts and intermediate transports are necessary, the invention also provides mechanisms which ensure a transport of the blank stacks without endangering the stack arrangement.

18 Claims, 9 Drawing Sheets

APPARATUS INCLUDING AN ENDLESS POCKET CONVEYOR FOR AUTOMATICALLY TRANSFERRING STACKS OF PACKAGING BLANKS TO A BLANK MAGAZINE OF A PACKAGING MACHINE

BACKGROUND OF THE INVENTION

The invention relates to a packaging machine for producing especially hinge lid packs for cigarettes or the like made of individual blanks produced outside of the region of the packaging machine.

An important requirement for a trouble-free mode of operation of high performance packaging machines is a fast and sufficient supply of packaging material. Usually, a magazine for blanks produced elsewhere is associated with the packaging machine. The magazine can hold only a limited supply of packaging material and therefore has to be refilled continuously.

SUMMARY OF THE INVENTION

The invention is based on the object to construct the afore-mentioned packaging machine such that the magazine for the packaging material can be continuously refilled without any trouble and without any appreciable service labour.

By employing an endless conveyor with pockets (pocket conveyor) for receiving a blank stack each from the feed station and transferring said stack into the region of the blank magazine, it is ensured that the packaging material (blank stacks) delivered in stacks from somewhere else can be fed to the blank magazine in this stacked form. This means that the packaging material can be filled into the blank magazine in the form in which it has been delivered, without having to be separated or the like. As a result of the use of an endless conveyor with pockets, i.e. a pocket conveyor, the blanks of the blank stacks to be transported cannot be displaced within the stacks either, since they are held in the pockets of the endless carrier in their proper stack position during transport.

According to the invention, the pocket conveyor is designed as a horizontal circular conveyor located in a plane above the packaging machine.

The blank stacks are usually delivered on pallets. Depending on how much the depalletizing process has progressed, the stack of the packaging material which is fed to the pocket conveyors has a different height. Consequently, the unloading height of the packaging material delivered on pallets and the feed height of the pocket conveyor have to constantly be adapted to one another, so that the packaging material can be inserted into the pockets of the pocket conveyor. For this purpose, a vertical conveyor is provided upstream of the pocket conveyor which can lift the blank stacks (in groups) to the plane of the pockets.

The blank stacks are transferred from the vertical conveyor to the pockets of the pocket conveyor by means of a pushing device, pushing said stack, on the one hand, off the vertical conveyor and, on the other hand, into the pockets of the pocket conveyor.

According to the invention, the vertical conveyor is designed as a column conveyor with two vertical columns and a conveying plate mounted thereon in an up-and-down movable manner. This guarantees good access for the stacks of packaging material from the side of the feed station and this ensures further a troublefree transfer of the packaging material into the pockets of the pocket conveyor.

According to a further proposal of the invention, the vertical conveyor is provided with a horizontal endless conveyor belt. In lowered position of the vertical conveyor, a number of blank stacks can be pushed onto said endless conveyor belt which in lifted position can be pushed into the pockets of the pocket conveyor individually, in groups or as a whole. The horizontal endless conveyor belt is mounted on the vertical conveyor via deflecting rollers in such a way that the upper strand essentially lies in the plane of the upper side of the conveying plate, which allows an easy shifting of the blank stacks. The endless conveyor belt can be driven (during the upward movement) in order to align the blank stacks with the pockets of the pocket conveyor.

Alternatively, the blank stacks can also be delivered by an overhead conveyor, which also feeds the blank stacks to the pocket conveyor. The overhead conveyor is preferably located in a plane above the pocket conveyor. In order to increase the conveying capacity of the overhead conveyor, it should expediently be designed such that each suspended runway trolley transports a group of blanks stacks.

Between overhead and pocket conveyor, a lowering conveyor is provided for passing on the blank stacks from the overhead conveyor to the pocket conveyor. This lowering conveyor lowers the blank stacks from the transport plane of the overhead conveyor to the receiving plane of the pocket conveyor. Here too, it is advisable to provide the lowering conveyor with compartments for receiving a blank stack each, especially with compartments having a variable distance between one another. This design makes it possible to change the original distance between the blank stacks coming from the feed station such that they can be transferred to pockets of the pocket conveyor having a different distance between one another, without having to rearrange said stacks.

An advantageous embodiment of the lowering conveyor is equipped with a conveying element mounted in an up-and-down movable manner, on which the compartments are mounted in a horizontally displaceable manner. The compartments are provided with a spindle drive for an easy change of the intermediate distances between the stacks.

A pushing device is provided for transferring the blank stacks from the lowering conveyor to the pockets of the pocket conveyor, said pushing device being mounted on posts in a vertically adjustable way.

The invention will be described in more detail below with reference to the drawings, in which:

DESCRIPTION OF PREFERRED EMBODIMENTS OF THE INVENTION

Figure 1:
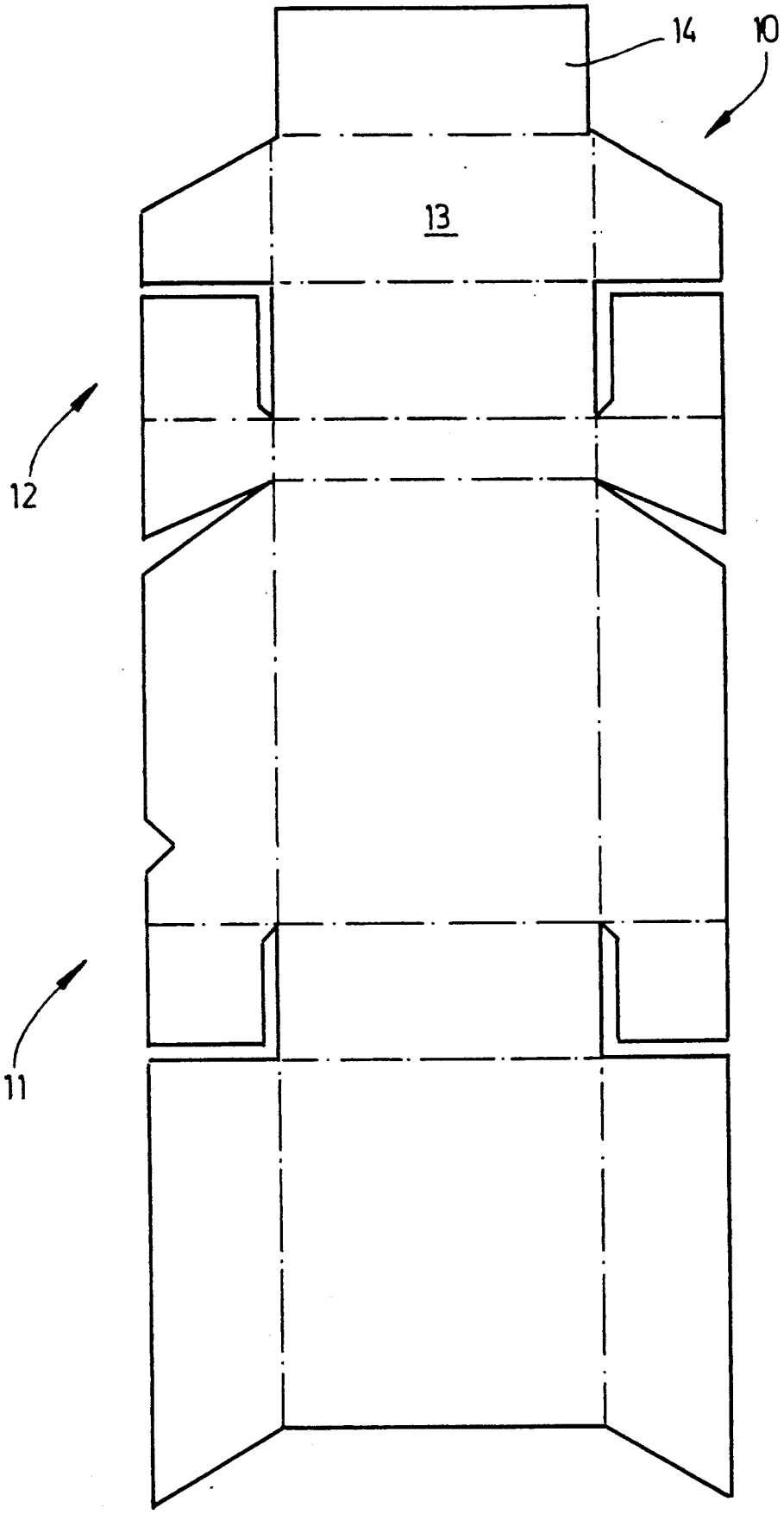
FIG. 1 shows a spread-out blank for a hinge lid box for packing cigarettes, this box being the preferred form of packaging material which is to be processed with the packaging machine as taught by the invention.

The packaging machine shown in the drawings and the individual units thereof are particularly designed for the handling of blanks 10 for producing (cigarette) hinge lid packs. An embodiment of such a blank 10 is shown in FIG. 1. The—world-wide customary—shape of the blank 10 is important for the mode of operation of parts of the packaging machine. This blank consists of a plurality of walls and folding tabs for forming a box part 11 on the one hand and a lid 12 on the other hand. In the present context, the shape of the parts of lid 12 is important. A lid front wall 13, being the end portion of the elongate blank 10, is provided with an inner lid tab 14, which, in the finished hinge lid pack, is inwardly folded, namely against the inside of the lid front wall 13. The inner lid tab has a significantly smaller width than the rest of blank 10. As a result, a blank stack 15 made of these blanks 10 (see for instance FIG. 2) forms a projection on one side. Such blank stacks 15 can be fed to the feed station of the packaging machine for example stacked on pallets, arranged behind one another in rows and several blank stacks 15 lying side-by-side. This is for instance the case in the embodiment of the packaging machine as taught by the invention according to FIG. 2. Nevertheless, the blank stacks 15 may also be delivered and supplied via the feed station for further handling within the packaging machine in other forms or arrangements. This is the case in the embodiment of the packaging machine as taught by the invention according to FIG. 5.

Figure 2:
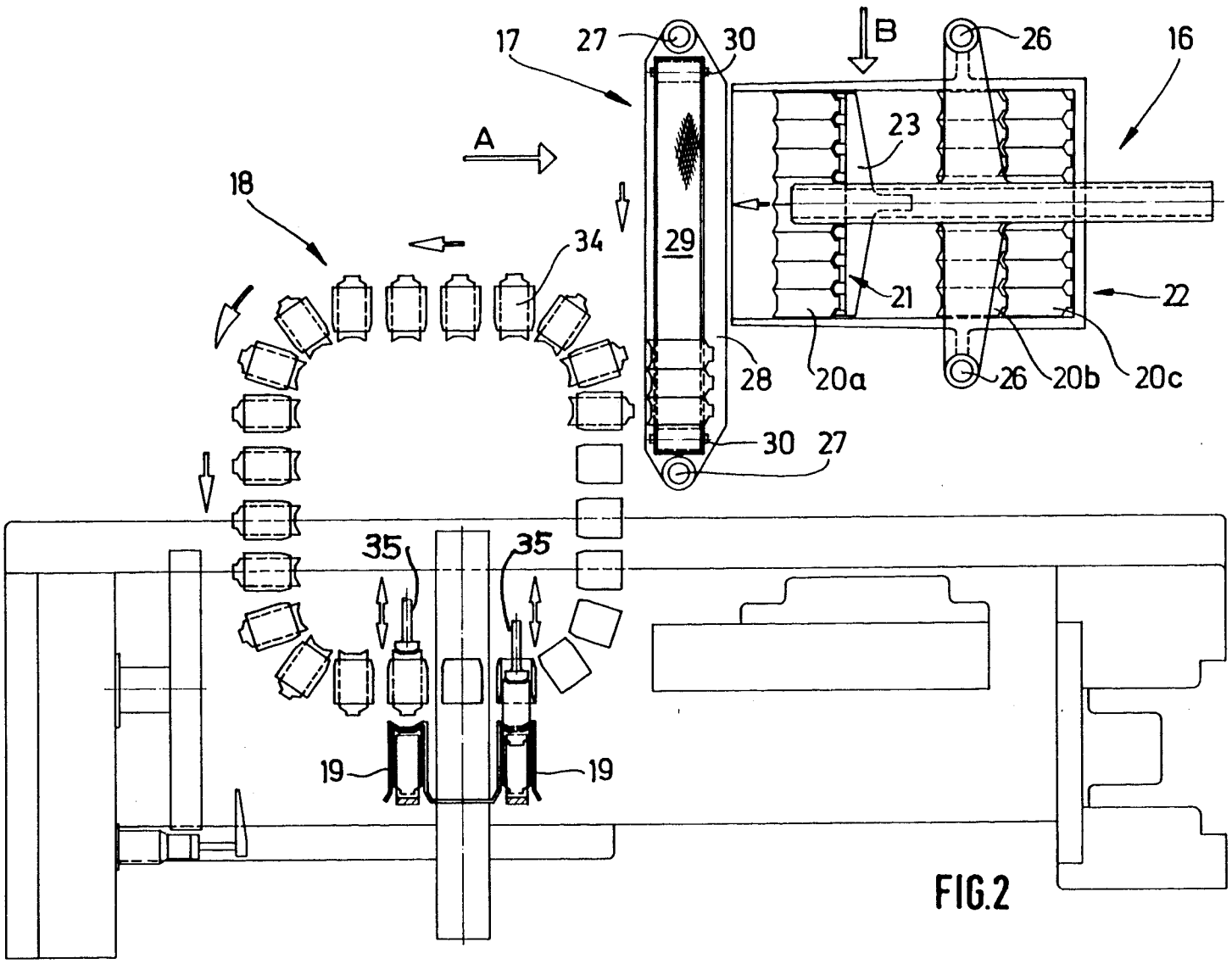
FIG. 2 is a top plan view of a first embodiment of a packaging machine as taught by the invention.
Figure 3:
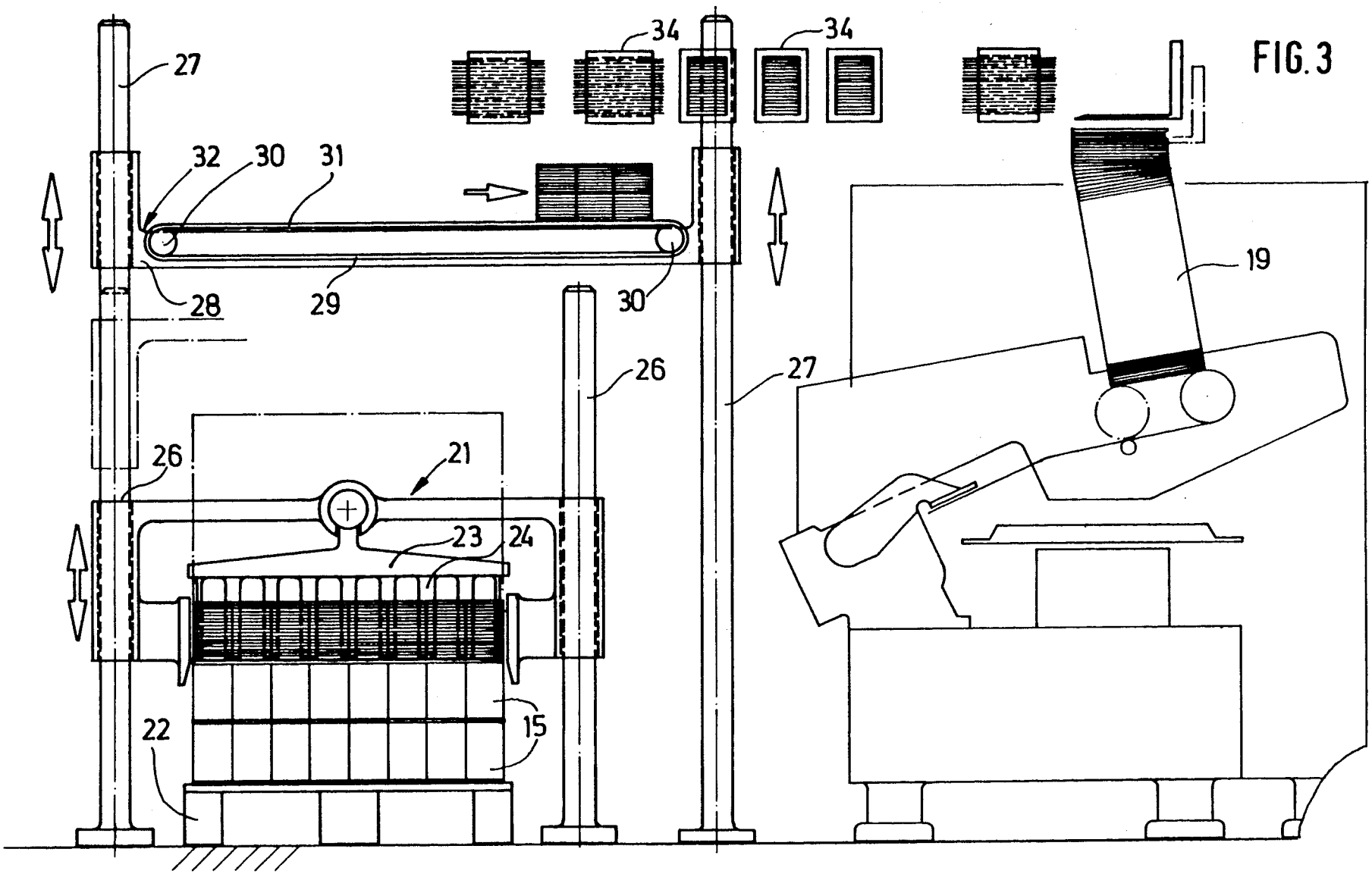
FIG. 3 is a partial side view of a packaging machine of FIG. 2, seen from the direction of arrow A of FIG. 2.

In the packaging machine of FIG. 2, a vertical conveyor 17 is provided downstream of a feed station 16. Blank stacks 15 supplied from the feed station 16 can be passed on to a pocket conveyor 18 by means of this vertical conveyor 17. The pocket conveyor 18 delivers the blank stacks 15 to blank magazines 19 located on the side of the machine, from where the packaging machine takes out the blanks 10 individually for further packing processes.

The feed station 16 is also designed as a depalletizing station in which the blank stacks 15 lying behind one another in rows 20*a*, 20*b* and 20*c* are pushed in rows from the upmost layer of a stacking pallet 22 from said pallet 22 onto the vertical conveyor 17 in one movement by means of a push-out device 21.

The push-out device 21 comprises a pusher 23 which is formed in the shape of a rake whose prongs 24 serve for entering openings, that is to say for abutting recesses 25 disposed at the rear side of the blanks 10. The push-out device 21 is on the whole mounted on posts 26, along which it can be moved up and down to allow for adjustment to the respective height of the upmost layer of blanks 15 on the stacking pallet 22. The vertical adjustability of the push-out device 21 also serves for inserting the prongs 24 into the recesses 25 disposed at the rear side of the blank stacks 15, for example for engaging row 20*a* of the blank stacks 15 to push said row 20*a* out, without disturbing the order of the next row of blank stacks.

The vertical conveyor 17 arranged downstream of the feed station 16 is designed as a column conveyor with two vertical columns 27, on which a conveying plate 28 can be moved up and down. The vertical conveyor 17 also has an endless conveyor belt 29 which is arranged on the conveying plate 28 via deflecting rollers in such a way that its upper strand 31 essentially lies in the plane of the top side 32 of the conveying plate 28. The endless conveyor belt 29 can be moved in steps in order to move the blank stacks 15 received thereon from the receiving position to a transfer position, from which said blank stacks 15 are passed on to the pocket conveyor 18.

Figure 4:
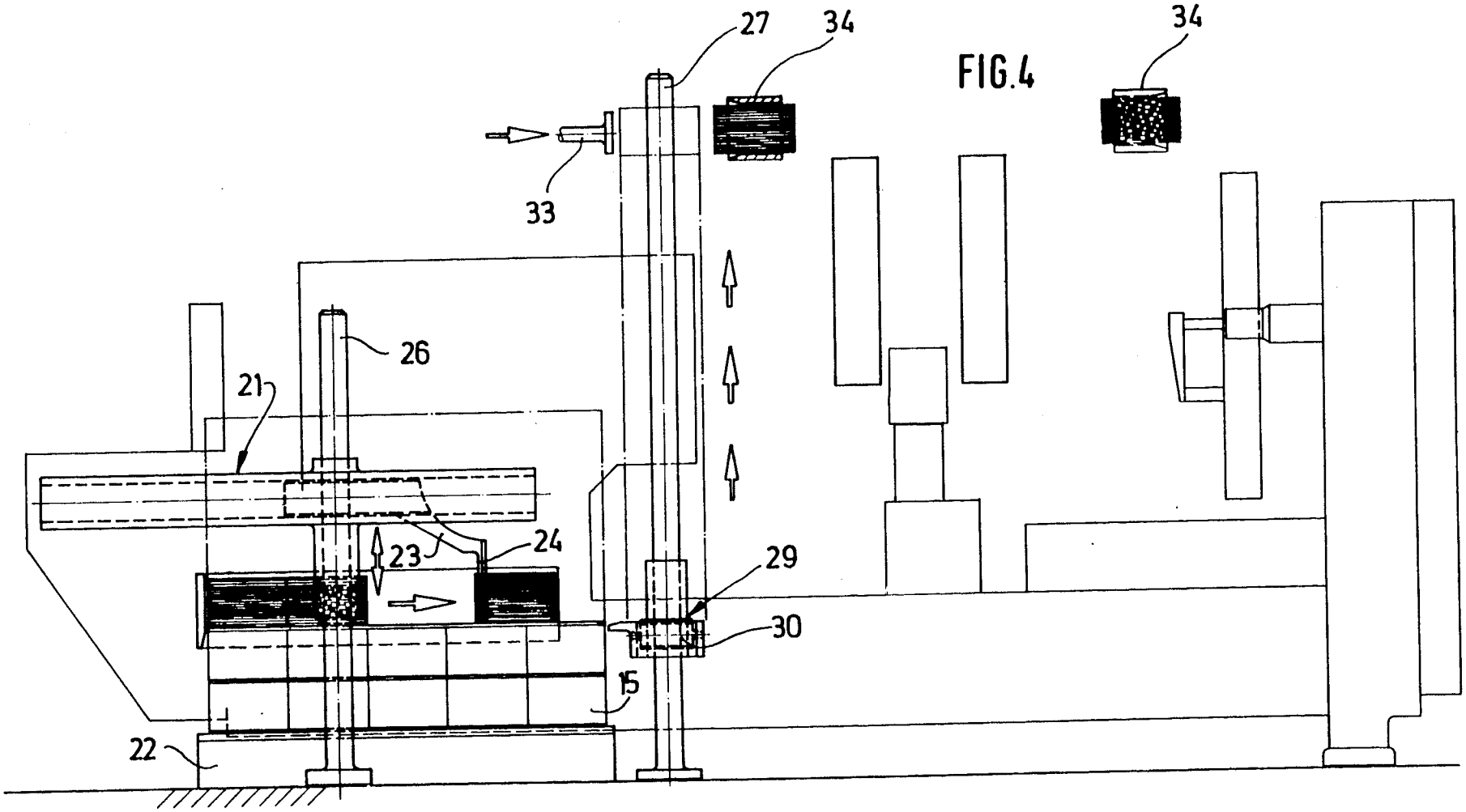
FIG. 4 is a partial side view of the packaging machine of FIG. 2, seen from the direction of arrow B of FIG. 2.

A pushing device 33, only schematically sketched in FIG. 4, is provided for this transfer. The blank stacks located on the upper strand 31 of the vertical conveyor 17 can be individually transferred into the pockets 34 of the pocket conveyor 18 by means of this pushing device 33 when such a pocket 34 is located opposite said pushing device 33.

A pushing device 35 serves for pushing the blank stacks 15 out of the pockets 34 of the pocket conveyor 18 and at the same time into the blank magazines 19 of the packaging machine.

In the embodiment of the packaging machine according to the invention as shown in FIGS. 5 to 8, blank stacks 15 are fed to the pocket conveyor 18 by means of an overhead conveyor 36. Place and manner of the loading of the runway trolley 37 of the overhead conveyor with blank stacks is irrelevant in this context. The suspended runway trolley 37 of the overhead conveyor, being loaded with blank stacks 15, is suspended from a rail track 38 in a to-and-fro movable manner and has a receiving room 39 designed in the form of a cassette, which if necessary can be separated into individual compartments. Instead of mounting the runway trolley 37 in a to-and-fro movable manner, a circular path of several runway trolleys 37 could also be provided with an appropriate course of the rail track 38.

The rail track 38 is arranged above the plane of the pocket conveyor 18, at a height sufficient to move the bottom side of the runway trolley 37 over the pocket conveyor 18 without any collisions.

In the central region of the pocket conveyor 18, where the runway trolleys 37 have to be emptied, a lowering conveyor 41 is provided between a partial region 40 of the pocket conveyor 18 and the rail track 38. This lowering conveyor 41 is designed as a column conveyor with two vertical columns 42 and a conveying element 43 mounted thereon in an up-and-down movable manner. A pushing device 44 located in the central region of the pocket conveyor 18 serves for pushing the blank stacks 15 out of the receiving room 39, possibly divided into compartments, of the runway trolleys 37 and at the same time onto the lowering conveyor 41.

The lowering conveyor 41 comprises several compartments, in the shown embodiment four compartments 45, which are attached to the vertically adjustable conveying element 43 of said lowering conveyor 41, specifically in a way that the lateral distance between the compartments 45 is variable. For this purpose, there is provided a spindle drive 46 parallel to the conveying element 43, by means of which the compartments 45 can on the one hand be moved into a position, in which the lateral distance between them corresponds to the lateral distance between the blank stacks 15 located in the receiving room 39 of the suspended runway trolleys 37. On the other hand, the compartments 45 can be moved that far away from one another, that the distance between them corresponds to the arrangement of the pockets 34 of the pocket conveyor 18 within the region 40 thereof.

For transferring the blank stacks 15 from the receiving room 39 of the runway trolleys 37 to the compartments 45 of the lowering conveyor 41, the compartments 45 at first have to be arranged in the necessary way close to one another, the lowering conveyor 41 having to be moved at the same time to a lifted position, so that the blank stacks 15 can be pushed out of the receiving room 39 of the runway trolleys 37 into the compartments 45 of the lowering conveyor 41 by means of the pushing device 44. After the blank stacks 15 have thus been transferred, the lowering conveyor is moved to a lowered position, in which the height of the compartments 45 of the latter corresponds to that of the pockets 34 of the pocket conveyor 18 in the region 40 thereof. At the same time, the compartments 45 are moved apart from one another, thus ensuring that the compartments 45 can be assigned to the pockets 34, located in the region 40, of the pocket conveyor 18 in a laterally correct manner as well. As soon as this has been achieved, a pushing device 47 is activated, pushing the blank stacks 15 out of the compartments 45 of the lowering conveyor 41 and into the pockets 34 of the pocket conveyor 18.

A pushing device 48 serves for transferring blank stacks 15 from the pockets 34 of the pocket conveyor 18 to the blank magazines 19 of the packaging machine. This pushing device 48 can for example be arranged opposite the region 40 of the pocket conveyor 18, as shown in FIG. 5.

Figure 5:
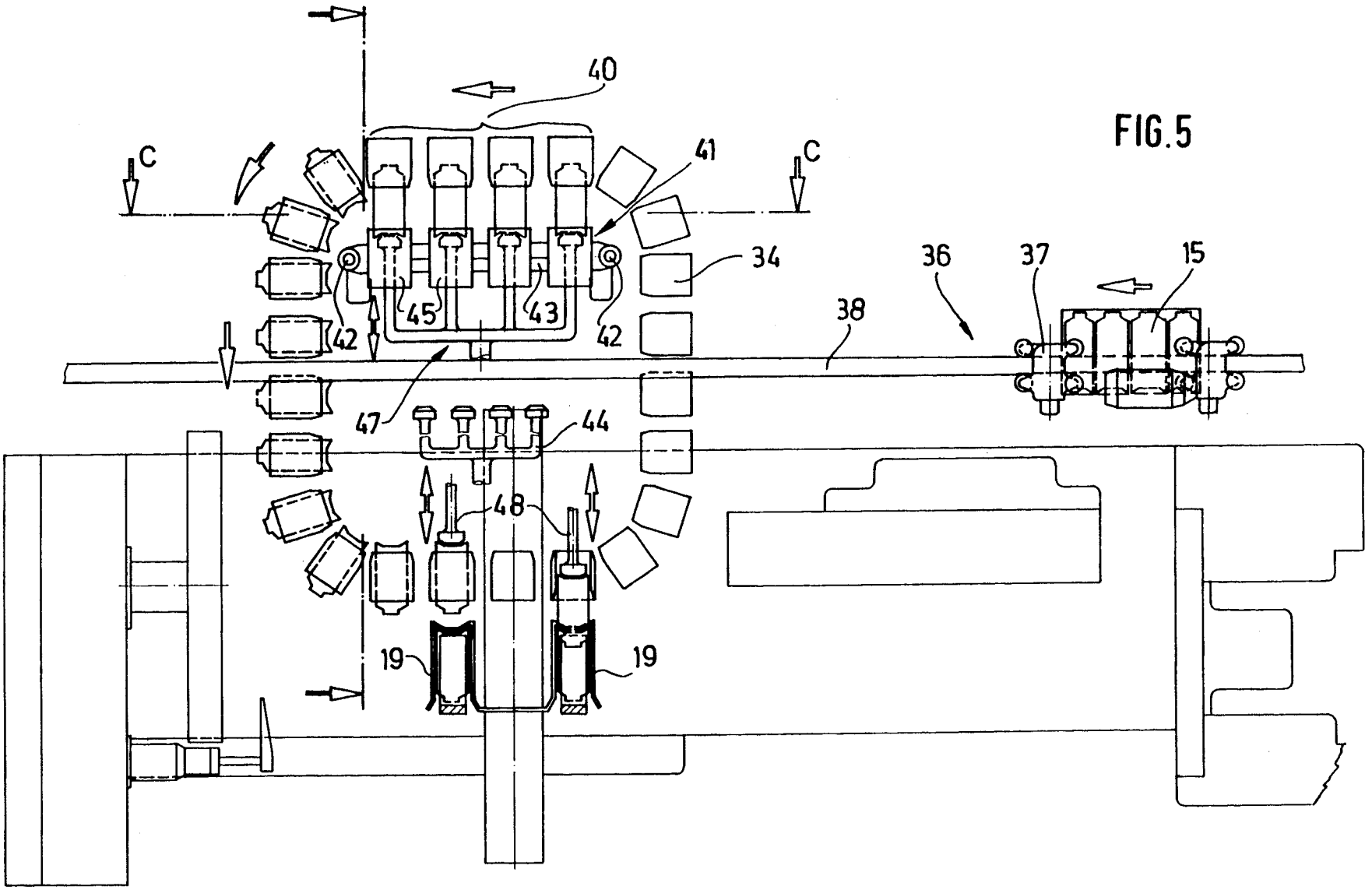
FIG. 5 is a top plan view of another embodiment of the packaging machine as taught by the invention.
Figure 6:
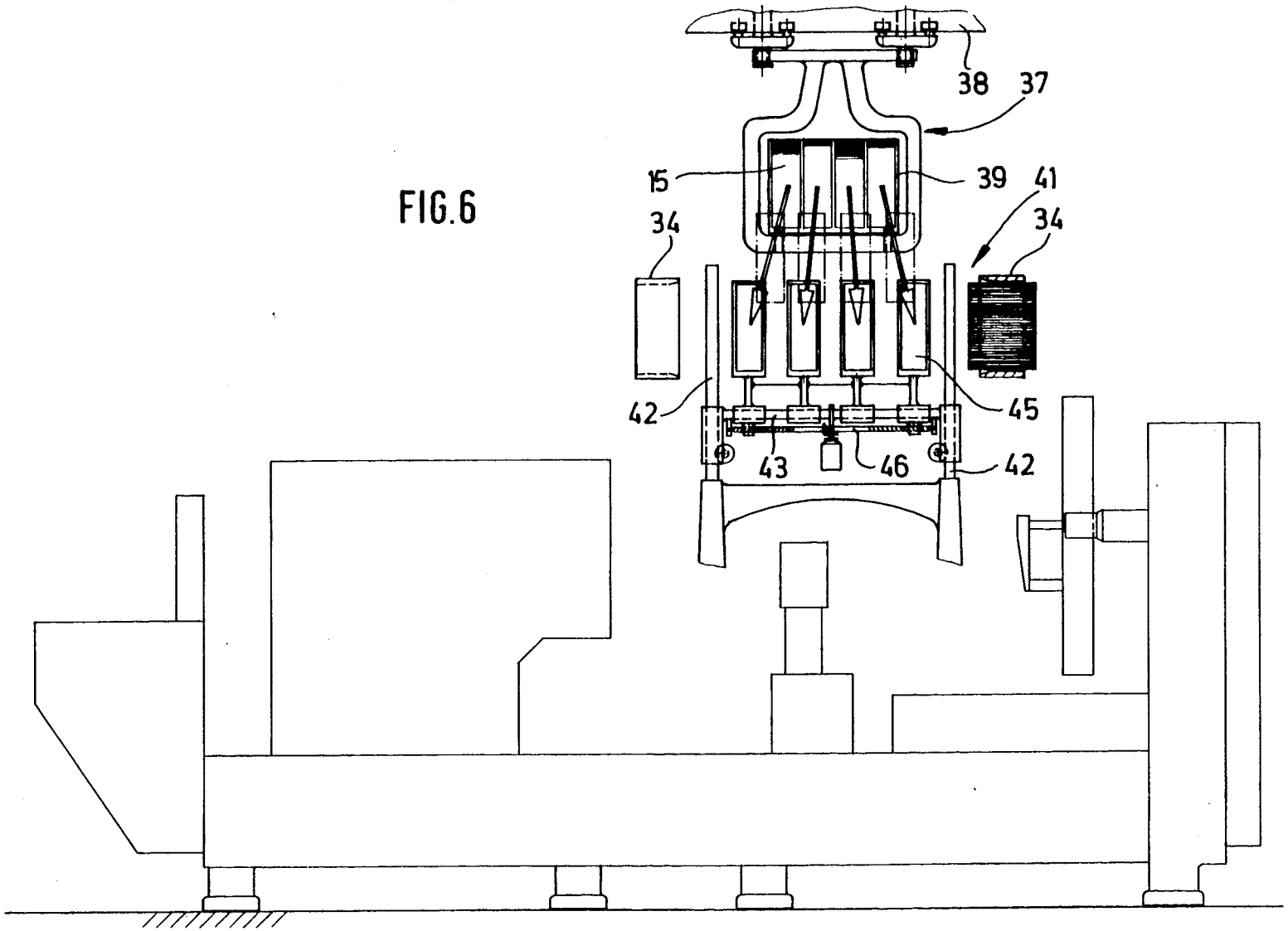
FIG. 6 is a partial side view of the packaging machine of FIG. 5, seen from the direction of arrows C—C of FIG. 5, showing the lowering conveyor.
Figure 7:
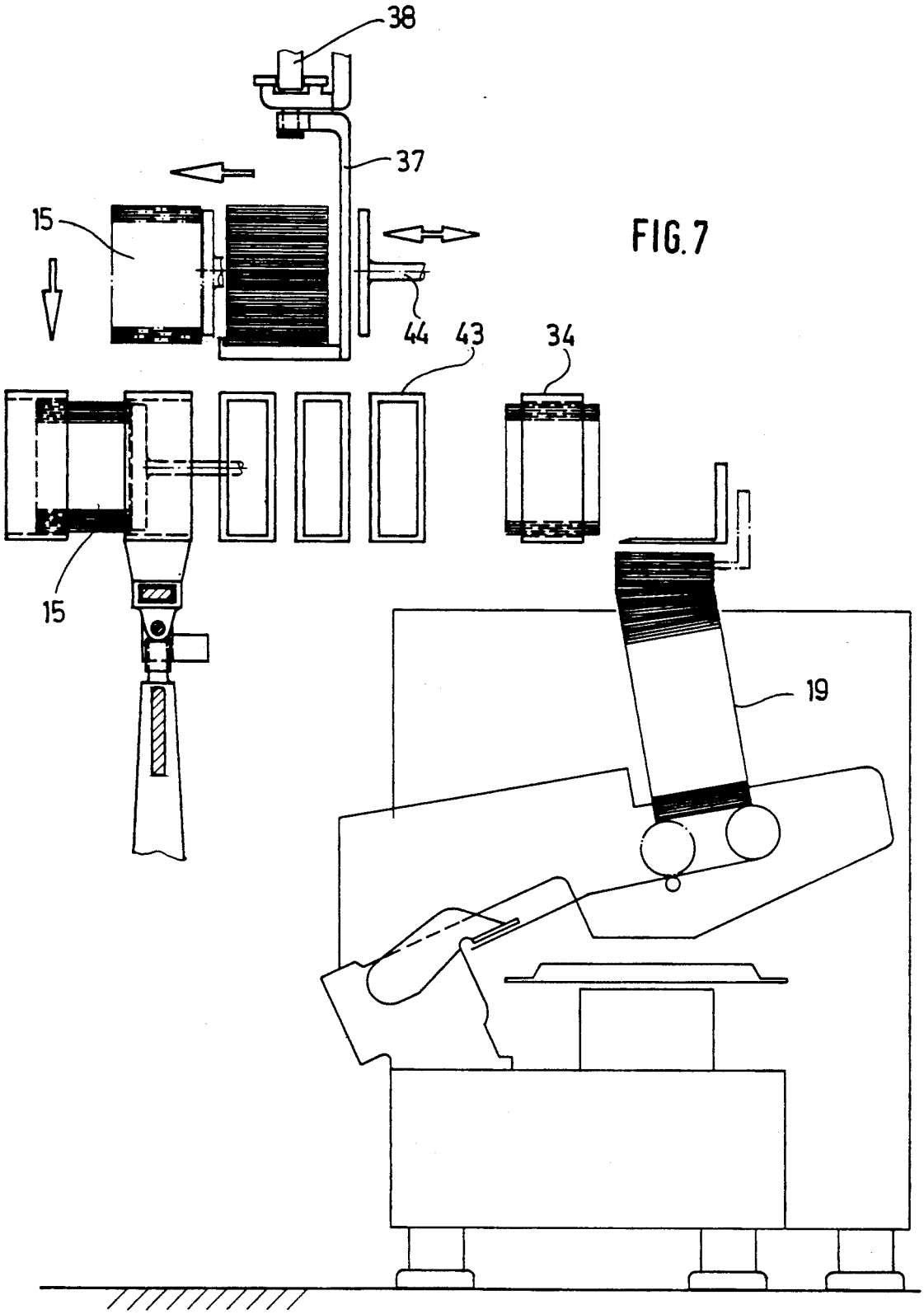
FIG. 7 shows a representation of the second embodiment, partially corresponding to the representation of FIG. 3, showing the runway trolley conveyor.
Figure 8:
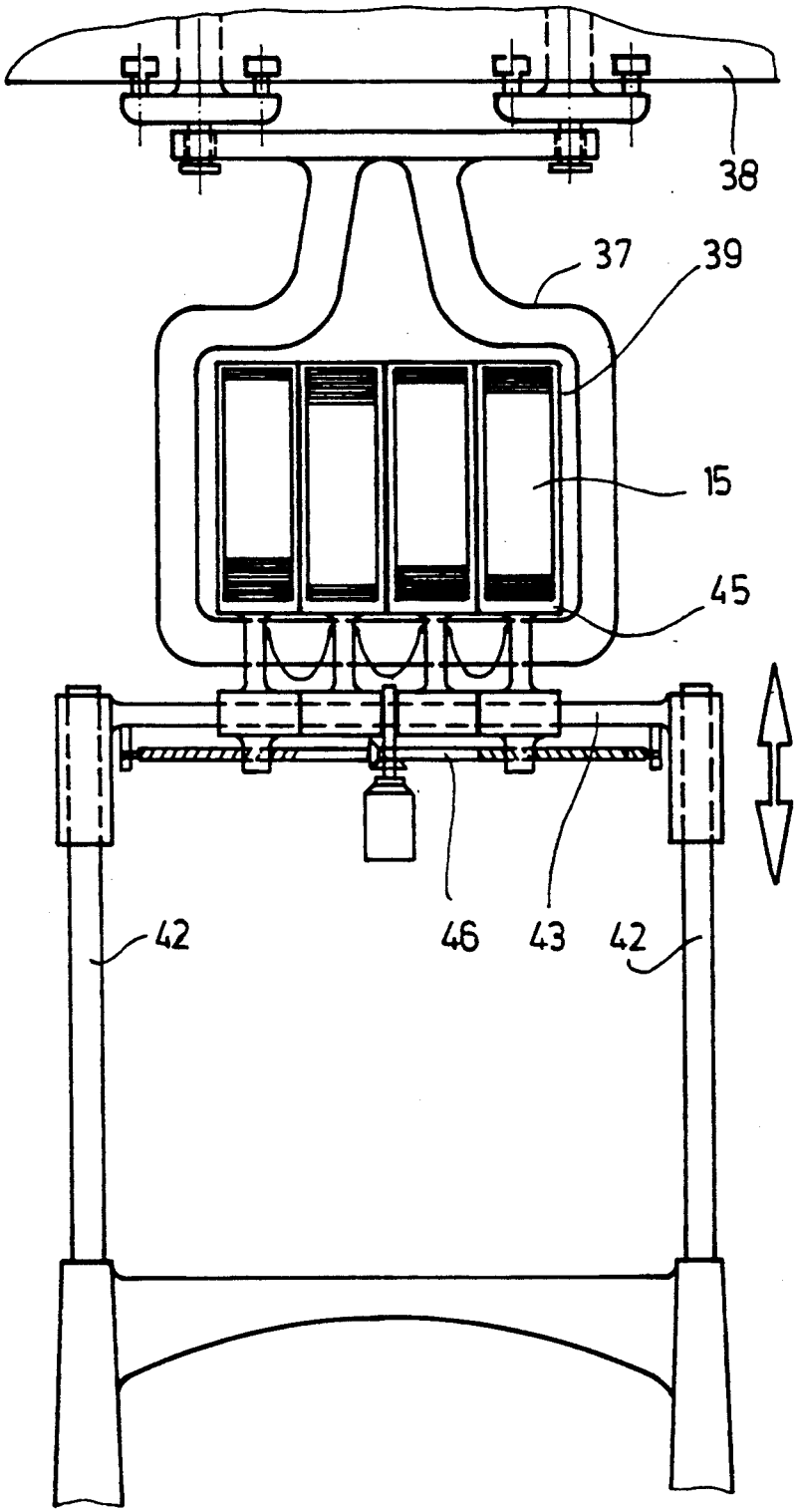
FIG. 8 shows a detail of the packaging machine, similar to the representation of FIG. 6, but with the lowering conveyor being lifted.
Figure 9:
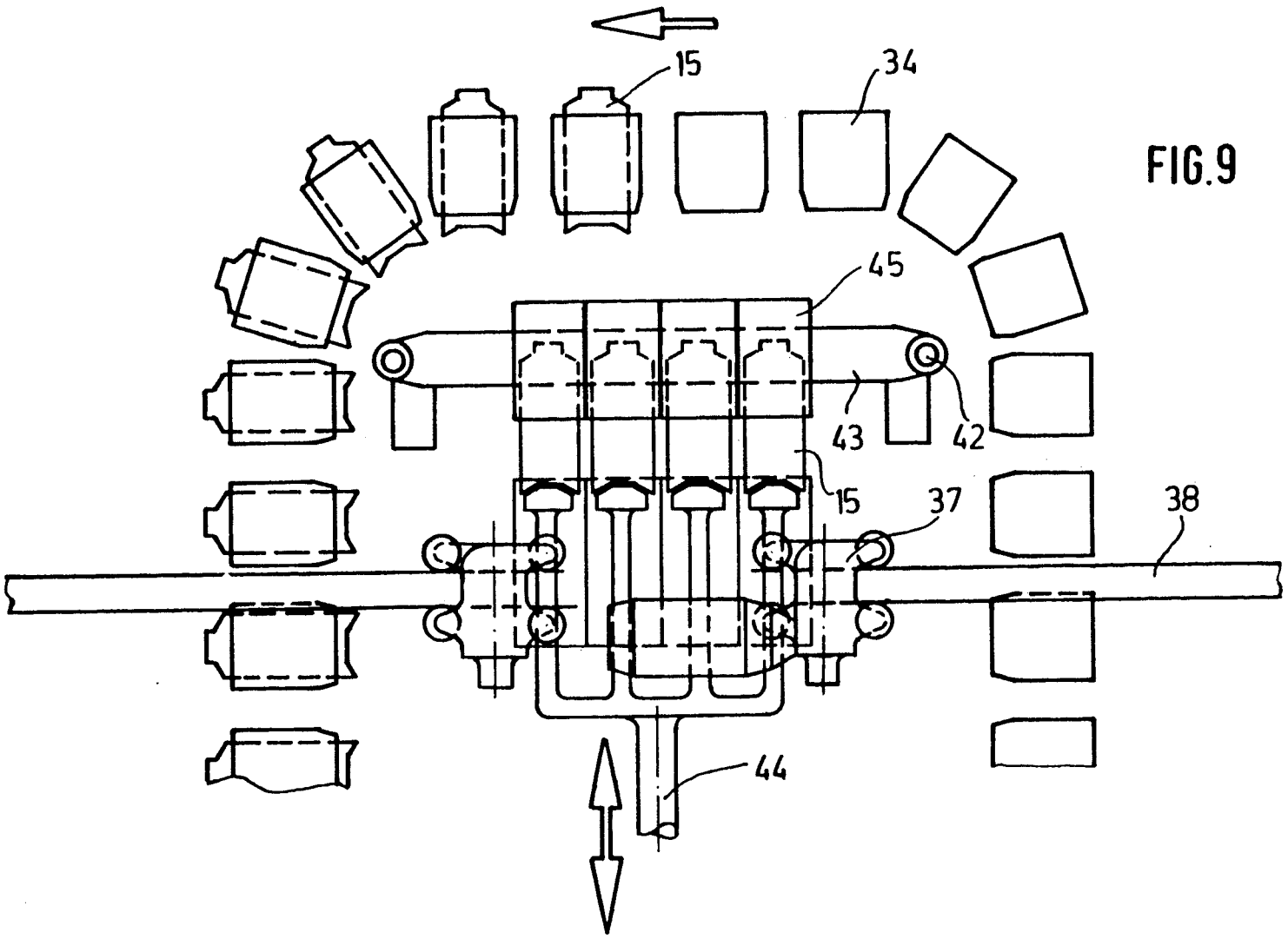
FIG. 9 is a top plan view of a detail of the packaging machine of FIG. 5, while the blank stacks are being pushed out of the compartments of the suspended runway trolley and into the compartments of the lowering conveyor.

Both embodiments of the packaging machine according to the invention, i.e. the embodiment according to FIG. 2 as well as the one according to FIG. 5, ensure a transport of the packaging material, especially in the form of blank stacks 15, to the actual packaging unit, starting from a feed station 16, which may be designed as a depalletizing station for delivered blank stacks 15. The blank stacks could also be delivered from somewhere else already held in cassettes or the like and the cassette contents can then be transferred to the receiving room of a runway trolley, or the whole cassette can be transferred to the runway trolley. The blanks can be quickly transported and transferred to the blank magazines 19 of the packaging machine without any problems, and without exposing the stacks of packaging material to the risk of having their arrangement disturbed or the like, for instance as a result of jerky accelerations or decelerations. Particularly the possibility of shifting several stacks of packaging material simultaneously parallel to one another during all stages of this transport of packaging material to the actual packaging unit, ensures a continuous operation even of packaging machines operating at top speed and even with those machines in which several blanks are simultaneously processed on several tracks in the actual packaging unit.

What is claimed is:

1. An apparatus for conveying stacks of blanks to a packaging machine, said apparatus comprisisng;

a blank magazine;

an endless pocket conveyor (18) movable in a horizontal plane, said pocket conveyor having a plurality of pockets (34) for holding the stacks, wherein said pockets (34) are movable in said horizontal plane and have two oppositely arranged open ends;

first pushing means (35, 48) for horizontally entering one of said open ends and horizontally pushing the blank stacks (15) out of the other of said open ends and into the blank magazine (19); and vertical conveyor means (17) disposed adjacent the pocket conveyor (18), said vertical conveyor means (17) having a vertically movable conveying plate (28) for lifting the blank stacks (15) to said horizontal plane containing said pocket conveyor (18);

wherein said vertical conveyor means (17) comprises a horizontal endless conveyor belt means (29) which receives a number of blank stacks (15) when said conveying plate (28) is in a lowered position, and wherein said blank stacks (15) are horizontally pushable into pockets (34) of the pocket conveyor (18) from said horizontal endless conveyor belt means (29) when said conveying plate (28) is in a lifted position in said horizontal plane.

2. The apparatus as claimed in claim 1, further comprising second pushing means (33), movable in said horizontal plane of the pocket conveyor (18), for pushing the blank stacks (15) from the vertical conveyor means (17) and into the pockets (34) of the pocket conveyor (18).

3. The apparatus as claimed in claims 2 or 1, wherein the horizontal endless conveyor belt means (29) is mounted on the conveying plate (28) by deflecting rollers (30), such that an upper strand (31) of said conveyor belt means (29) essentially lies in a plane containing a top side (32) of said conveying plate (28), the blank stacks (15) being in succession pushable off said endless conveyor belt means (29).

4. The apparatus as claimed in claim 3, further comprising push-out means (21), disposed at a blank feed station (16), for pushing the blank stacks (15) from a blank stack supply onto the upper strand (31) of the endless conveyor belt means (29).

5. The apparatus as claimed in claim 4, wherein the push-out means (21) is mounted on posts (26) in a vertically adjustable manner.

6. The apparatus as claimed in claim 5, wherein a pusher (23) of said push-out means (21) is formed in the shape of a rake, with prongs (24) designed to abut a blank stack (15), which is to be pushed out, in a region of recesses (25) of the blanks (10).

7. An apparatus for conveying stacks of blanks to a packaging machine, said apparatus comprising:

a) a blank magazine (19) associated with the packaging machine;

b) an endless pocket conveyor, movable in a horizontal plane, for intermittently feeding the blanks to the blank magazine (19), c) said endless pocket conveyor (18) having a plurality of individual pockets (34) for holding individual stacks (15) of the blanks, said pockets being movable only in said horizontal plane;

d) conveyor means (17, 36) for conveying individual blank stacks (15) to the individual pockets (34), e) wherein each of said pockets (34) has a generally rectangular configuration, each pocket being closed at a top, a bottom and two sides thereof and having two oppositely arranged open ends; and f) first pushing means (35, 48), located near said blank magazine (19), for horizontally entering one of said open ends of said pocket and horizontally pushing the blank stacks (15) out of the other of said open ends and into the blank magazine (19).

8. The packaging machine as claimed in claim 7, wherein said conveyor means (17, 36) comprises vertical conveyor means (17) disposed adjacent the pocket conveyor (18), said vertical conveyor means (17) having a vertically movable conveying plate (28) for lifting the blank stacks (15) to said horizontal plane containing said pocket conveyor (18).

9. The apparatus as claimed in claim 7, wherein said conveyor means comprises an overhead conveyor (36), arranged vertically above the pocket conveyor (18), for conveying the blank stacks (15) to the pocket conveyor (18) in a plane above said pocket conveyor (18).

10. The apparatus as claimed in claim 9, wherein said overhead conveyor (36) has suspended runway trolleys (37), each for receiving a plurality of blank stacks (15).

11. The apparatus as claimed in claim 9, comprising a lowering conveyor (41) for downwardly moving the blank stacks (15) from said overhead conveyor (36) to the horizontal plane of the pocket conveyor (18).

12. The apparatus as claimed in claim 11, wherein a pushing device (44) is associated with said overhead conveyor (36) for pushing the blank stacks (15) off the overhead conveyor (36) and onto the lowering conveyor (41) when the lowering conveyor is in a lifted position.

13. The apparatus as claimed in claims 11 or 12, wherein said lowering conveyor (41) is equipped with compartments (45), each for receiving one blank stack (15), said compartments (45) being separated by a variable distance.

14. The apparatus as claimed in claim 13, wherein said lowering conveyor (41) comprises two vertical columns (42) and a conveying element (43) vertically movable on the columns.

15. The apparatus as claimed in claim 14, wherein the compartments (45) of said lowering conveyor (41) are mounted in a horizontally shiftable manner on said conveying element by a spindle drive (46).

16. The apparatus as claimed in claim 11, further comprising a pushing device (47) (41) movable in the horizontal plane of said pocket conveyor (18) for pushing the blank stacks (15) off the lowering conveyor (41) and into the pockets (34) of the pocket conveyor (18).

17. The apparatus as claimed in claim 7, wherein each open end of the pockets (34) has a cross-section sufficient to allow passage of the blank stacks (15) therethrough.

18. The apparatus as claimed in claim 8, further comprising second pushing means (33), movable in said horizontal plane of the pocket conveyor (18), for pushing the blank stacks (15) from the vertical conveyor means (17) and into the pockets (34) of the pocket conveyor (18).

* * * * *